US005430986A

United States Patent [19]

Vagedes

[11] Patent Number: 5,430,986

[45] **Date of Patent: * Jul. 11, 1995**

[54] SHUTTER ASSEMBLY

[75] Inventor: Michael Vagedes, Florence, Ky.

[73] Assignee: Richwood Building Products, Richwood, Ky.

[ * ] Notice: The portion of the term of this patent subsequent to Sep. 20, 2011 has been disclaimed.

[21] Appl. No.: 173,822

[22] Filed: Dec. 27, 1993

Related U.S. Application Data

[63] Continuation-in-part of Ser. No. 60,316, May 11, 1993, Pat. No. 5,347,782.

[51] Int. Cl.[6] ..... E06B 7/08

[52] U.S. Cl. ..... 52/473

[58] Field of Search ..... 52/822, 827, 823, 829, 52/473, 455; 403/363, 375; 49/74.1, 403

[56] References Cited

U.S. PATENT DOCUMENTS

Re. 18,077 5/1931 Larson .
3,055,467 9/1962 Peek et al. ..... 52/473 X
3,191,242 6/1965 Rauen .
3,394,518 7/1968 Worrell, Jr. .
3,455,079 7/1969 Frederick .
3,527,486 9/1970 Gamp .
3,797,186 3/1974 Smith .
3,968,738 7/1976 Matzke .
4,193,245 3/1980 Johnson ..... 52/473 X
4,251,966 2/1981 Foltman .
4,381,633 5/1983 MacLeod ..... 52/473 X
4,765,110 8/1988 MacLeod .
4,858,400 8/1989 Foyt .
5,060,442 10/1991 Chubb .
5,152,116 10/1992 MacGowan .
5,347,782 9/1994 Vagedes ..... 52/473
5,373,677 12/1994 Vagedes ..... 52/473

*Primary Examiner*—Jerry Redman

[57] ABSTRACT

A shutter assembly is provided which includes a body portion and separate top and bottom caps. The length of the shutter is adjusted by sliding the caps so they cover more or less of the shutter body. The caps and body portion are then screwed to a building wall.

6 Claims, 3 Drawing Sheets

SHUTTER ASSEMBLY

This is a continuation in part of application Ser. No. 08/060,316, now U.S. Pat. No. 5,347,782, filed May 11, 1993, entitled Shutter Assembly.

BACKGROUND OF THE INVENTION

Most shutters which are now used with homes serve only an ornamental function. As such, most of these are formed by injection molding using colored plastic to permit formation of a plastic shutter which does not rot and generally does not require painting. Distributors simply stock shutters of different colors so that he can supply them to their customers.

In addition to a variety of a number of different colors, there are also a number of different sizes. Windows come in many different lengths and as such the shutter must correspond in size to the length of the window. Thus, the distributor must not only stock different colors but must stock different sizes, frequently ten to fifteen different sizes. The problem created by this is quite obvious. The stocking requirements are prohibitive for many distributors.

To overcome this problem, plastic shutters have been formed which can be adjusted in size. Several of these are disclosed in U.S. Pat. Nos. 5,152,116, 4,765,110, 3,455,079 and 4,251,966.

The problem with each of these designs is that the adjustment is too complex. Generally, the adjustment must be made by the distributor as opposed to the end user due to the complexity of the adjustment. Precise cuts are required plus assembly using various fasteners, plastic rivets and the like. This is totally unacceptable if one wishes to adjust the size of the shutter at the job site. Further, due to the large number of separate components, these shutters rattle and can easily fall apart.

SUMMARY OF THE INVENTION

Accordingly, it is an object of the present invention to provide a shutter which can be shortened easily and simply, permitting adjustment at the job site.

It is also an object of the present invention to provide such a shutter which can be lengthened or shortened easily, and quickly assembled and installed.

The objects and advantages of the present invention are obtained by providing a shutter which has a body portion without a fixed top and/or bottom end cap. The body portion is one molded piece including the stiles, mullion and slats. The end of the shutter is covered with a preformed end cap. The shutter is assembled by screwing through the end cap and through the body portion into the house, assembling the shutter and attaching it to the house at the same time.

The end cap can slide up or down the body portion providing up to about four inches of adjustment without cutting the body portion. Each end cap includes a front surface, two side surfaces and two rear edges which engage the shutter both on its front side and back providing a tight fit. The two rear edges include a plurality of ridges which are adapted to engage a plurality of bumps on the rear of the shutter body. This helps position the caps during installation.

The objects and advantages of the present invention will be further appreciated in light of the following detailed description and drawings in which:

DETAILED DESCRIPTION

Figure 1:
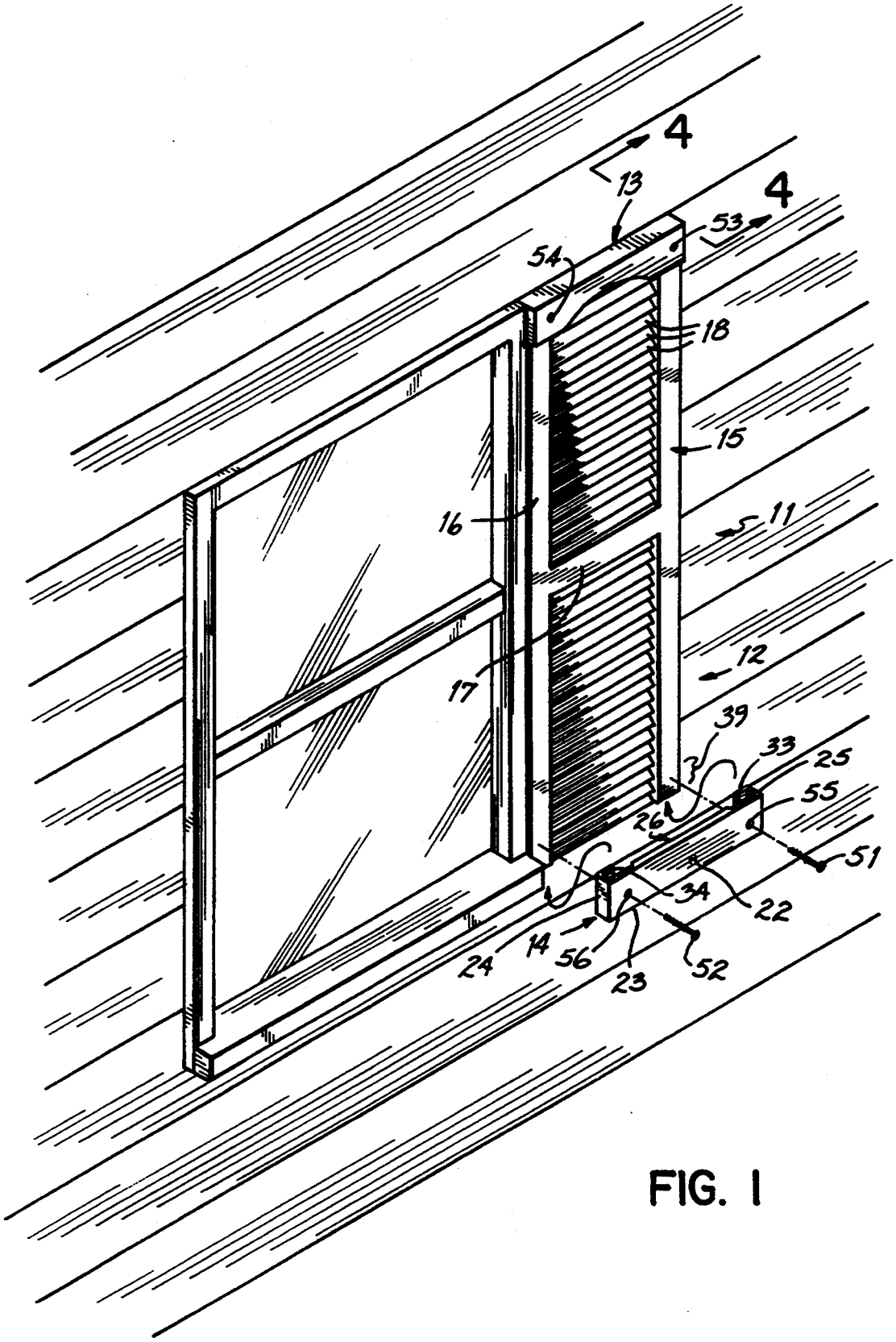
FIG. 1 is a perspective view of an assembled shutter as attached to a building.

The present invention is a plastic shutter assembly 11 preferably injection molded from, for example, polypropylene. As shown in FIG. 1, shutter assembly 11 includes a body portion 12, a top cap 13 and a bottom cap 14. The body portion 12 is formed as with most shutters having a right stile 15 and a left stile 16 parallel to each other. Separating the right stile 15 from the left stile 16 is a central mullion or panel 17. Likewise separating the two stiles are the slats 18 which are separated by spaces 19 therebetween to allow passage of air (see FIG. 3). Running through the central portion of the slats 18 is a vertical brace 21. The brace 21, slats 18, mullion 17 and stiles 15 and 16 are molded as one piece generally.

Except as noted, bottom cap 14 and top cap 13 are the same and only cap 14 is described in detail Bottom cap 14 includes a front panel 22 which has a horizontal endwall 23 and a first vertical sidewall 24 and a second vertical sidewall 25. Opposite the horizontal endwall 23 is a horizontal lip 26. (The horizontal lip of top cap 13 is curved for ornamental purposes.) The lip 26 does not extend all the way to the first and second vertical walls 24 and 25, but runs short stopping at edges 27 and 28. The distance from edges 27 and 28 to side walls 24 and 25 corresponds in size to the outer width of stiles 15 and 16 respectively.

Two vertical ledges 33 and 34 extend from the corner of end wall 23 and side walls 24 and 25, respectively. The area 37 and 38 between the ledges 33 and 34 and the front panel 22 of the caps 14 are just wide enough to permit the stiles 15 and 16 to snugly slide between the ledges 33 and 34 and panel 22. Ledges 33 and 34 include a series of horizontal ridges 41 and the inside edges 48 and 49 of stiles 15 and 16 include a series of bumps 40. Bumps 40 mate with or engage raised portions or ridges 41 as the stiles 15 and 16 are positioned within areas 37 and 38 (see FIGS. 3 and 4). This keeps the end caps in position relative to the shutter body 12 during installation. It also makes it easier to align the left and right sides of caps 13 and 14. These positioning bumps can be positioned anywhere on the caps and end portions of the shutter body as long as one or more bumps on the stile engage one or more bumps on the end cap.

The front panel 22 of cap 14 is at least about 1 inch long (as measured from lip 26 to end wall 23) and preferably 2 to 3 inches long. This provides sufficient area to cover the bottom portion 39 of the shutter body 12 as discussed below and to provide an area for screws to permit assembly of the shutter.

As previously discussed, the invention provides the means to adjust the length of the shutters so that they can be used for a variety of different windows. End caps which are three inches long can cover the top and bottom three inches of the shutter or they can cover as little as one inch. Thus, by sliding the top and bottom caps, the length of the shutter can be adjusted up to four inches. If desired, the top and/or bottom of the body portion can be cut to shorten the overall length.

The lip 26 has a width so that when the stiles rest against the inside surface of the cap, its inside edge 46 will be very close (about ⅛ inch) from the slats.

The shutter 11 is attached to the side of the house wall by screwing through the panel 22 through left and right stiles 15 and 16 and into the wall. This will be done with both the top and bottom caps so that four screws 51, 52, 53 and 54 are fastened through the caps 13 and 14 and stiles and into the wall holding the shutter assembly together and fastened to the building wall as shown.

Figures 2, 3, 4:
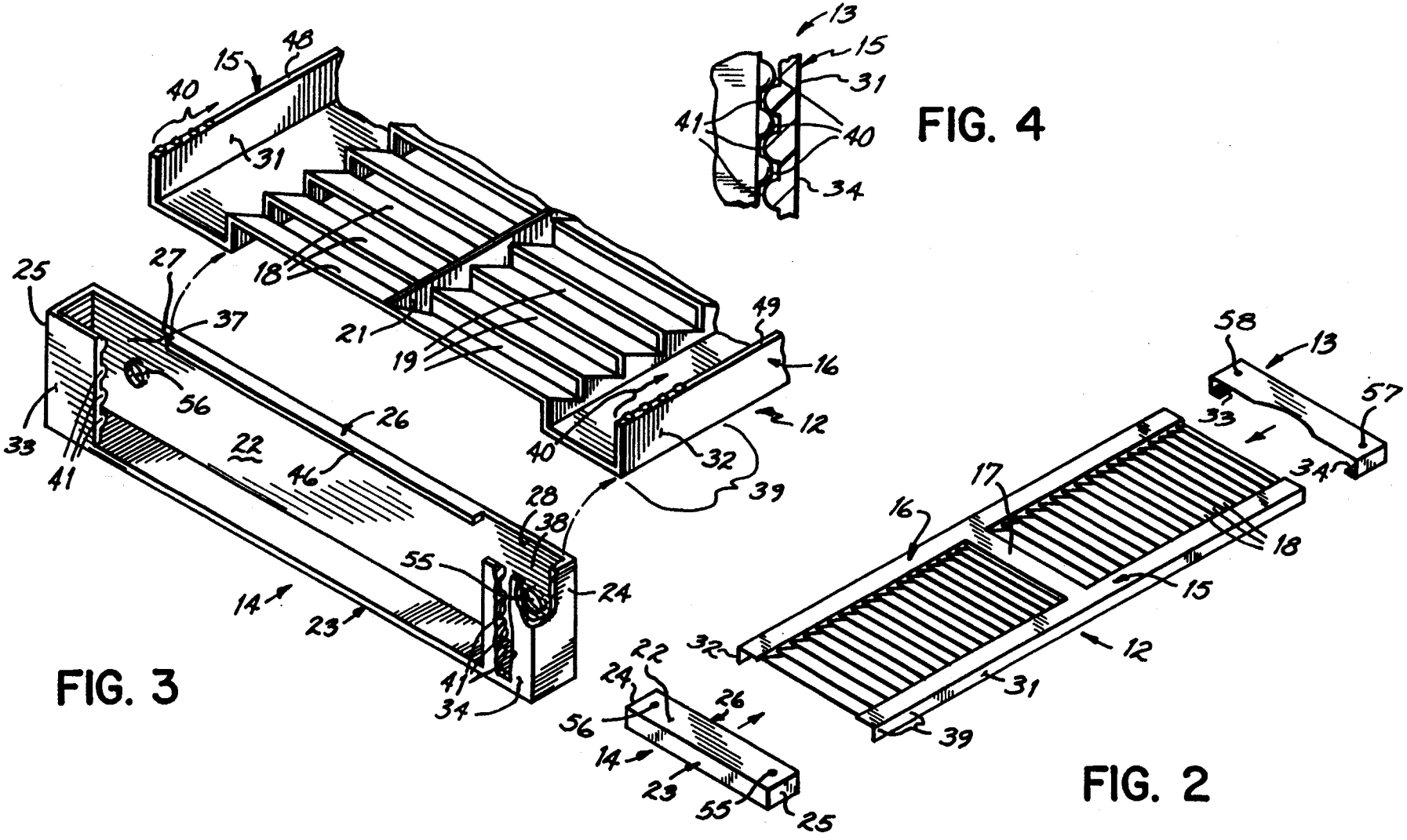
FIG. 2 is a perspective view showing the adjustment of the shutter.
FIG. 3 is a perspective view of a portion of the shutter showing the assembly of the cap onto the shutter body.
FIG. 4 is a cross-sectional view taken at lines 4—4 of FIG. 1.

As shown in FIGS. 2 and 3, caps 13 and 14 may include preformed holes 55, 56, 57, and 58 through panel 22 to assist in assembly. With the caps 13 and 14 on the body portion 12, holes can be drilled through the stiles using the holes 55–58 in the caps 13 and 14 as guides. The ledges 33 and 34 provide stability to the assembled shutter making sure that caps are properly aligned with the shutter body.

It may be preferred to have only a top cap and have the bottom cap a molded part of the body portion. This would limit the size adjustment, but would be less expensive.

Figure 5:
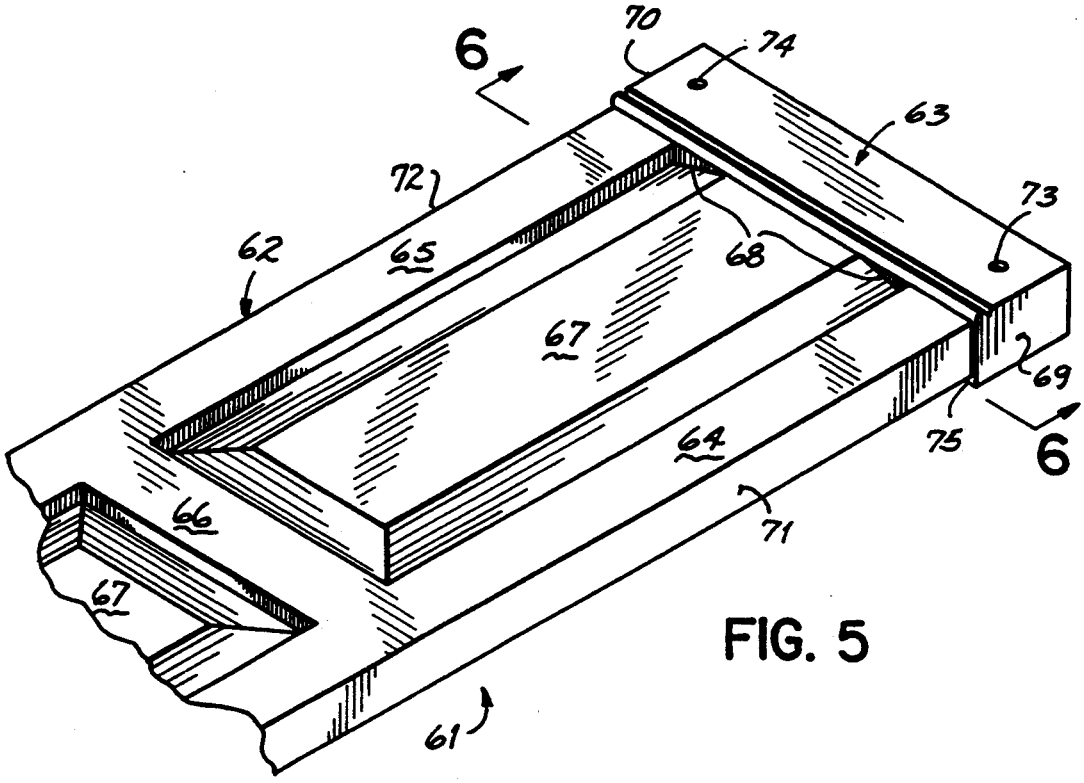
FIG. 5 is a perspective view of an alternate embodiment of the present invention.
Figure 6:
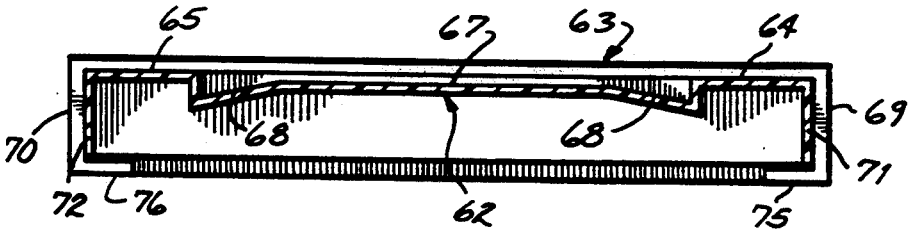
FIG. 6 is a cross-sectional view taken at lines 6—6 of FIG. 5.

An alternate embodiment of the present invention is shown in FIGS. 5 and 6. In this embodiment, the shutter assembly 61 includes a body portion 62 and a cap 63. Only the top portion of the shutter 61 is shown. However, the bottom portion of the shutter is a mirror image of the top portion. The body portion 62 likewise includes first and second stile, 64 and 65, and mullion 66. Between stiles 64 and 65 are raised panels 67. The presence of the raised panel 67 requires a modification of the end cap to facilitate conforming to its cross-sectional configuration. Accordingly, cap 63 has an edge 68 which corresponds to the cross-sectional configuration of the body portion as taken at line 6—6 and shown in FIG. 6. The cap portion 63 itself also has side walls 69 and 70 and ledges 75 and 76.

As with the first embodiment, the shutter assembly 61 can be adjusted as to size by covering selected portions of the top and bottom of the shutter 61 with cap 63 and a bottom cap (not shown). Screws can then be inserted through holes 73 and 74 to hold the shutter assembly together mounted to a building wall.

This has been a description of the present invention along with the preferred method of practicing the present invention. However, the present invention should be defined only by the appended claims wherein I claim:

1. A shutter assembly comprising a body portion;

an upper cap;

said body portion having an upper and lower portion and two parallel lateral stiles having a surface extending between said upper and lower portions;

said upper cap having a forward panel, a horizontal endwall, two opposed lateral walls and two rear ledges wherein said lateral walls extend over said surface of said two stiles with said forward panel of said upper cap covering said upper portion with said stiles positioned between said ledges and said forward panel;

whereby the length of said shutter can be adjusted by covering selected lengths of said upper portion with said upper cap.

2. The shutter assembly claimed in claim I further including a lower cap having a forward panel, a horizontal end wall, two opposed lateral walls and two rear ledges wherein said lateral walls extend over said two stiles with said forward panel of said lower cap covering said lower portion with said stiles positioned between said ledges and said forward panel.

3. The shutter assembly claimed in claim 2 wherein said body portion includes a plurality of slats extending between said stiles and wherein said slats are separated from each other by open areas with a central brace connecting said adjacent slats whereby said body portion can be shortened by only cutting each of said stiles and said brace in a straight line perpendicular to said stiles to shorten said body portion and thereby shorten said shutter assembly.

4. The shutter assembly claimed in claim 1 wherein said upper cap includes a plurality of spaced bumps adapted to engage at least one bump on an inside surface of said stiles.

5. The shutter assembly claimed in claim 1 wherein said body portion includes two raised panel portions extending between said stiles and wherein said end caps have a lower edge having a configuration complementary to a cross-section of said raised panel portions.

6. The shutter assembly claimed in claim 1 wherein said upper cap includes at least one bump adapted to engage a plurality of raised portions on an inside surface of said stiles.

* * * * *